United States Patent [19]

Taniguchi et al.

[11] Patent Number: 4,791,686

[45] Date of Patent: Dec. 20, 1988

[54] DEVICE FOR AUTOMATIC RINSING OF PRIVATE PARTS AFTER DEFECATION AND/OR URINATION OF PHYSICALLY DISABLED PERSONS

[76] Inventors: Harusige Taniguchi; Kyoko Taniguchi, both of 4-432, Ikebukuro, Toshima-ku, Tokyo, Japan

[21] Appl. No.: 855,170

[22] Filed: Apr. 22, 1986

[30] Foreign Application Priority Data

Apr. 27, 1985 [JP] Japan ..... 60-91743
Jun. 11, 1985 [JP] Japan ..... 60-125138

[51] Int. Cl.[4] ..... A61H 35/00

[52] U.S. Cl. ..... 4/448; 4/420.4; 4/144.3; 239/588

[58] Field of Search ..... 4/443–448, 4/420.1–420.5, 144.3; 239/588, 587, 67; 5/90; 604/65–67, 329

[56] References Cited

U.S. PATENT DOCUMENTS 3,922,735 12/1975 Kato ..... 4/420.2
3,925,826 12/1975 Huyot et al. ..... 4/420.4
4,050,103 9/1977 Nakao et al. ..... 4/144.3
4,137,579 2/1979 Soler ..... 4/144.3
4,237,560 12/1980 Riegelman et al. ..... 4/447
4,581,779 4/1986 Matsui et al. ..... 4/420.1
4,610,675 9/1986 Triunfol ..... 4/144.3
4,631,061 12/1986 Martin ..... 604/329

FOREIGN PATENT DOCUMENTS 2200033 7/1973 Fed. Rep. of Germany ..... 4/443
59-155252 9/1984 Japan .
750593 6/1956 United Kingdom ..... 4/444

*Primary Examiner*—Henry J. Recla
*Assistant Examiner*—Linda J. Sholl

[57] ABSTRACT

A device for automatically rinsing private parts of the user's body after urination and/or defecation is disclosed. The device is comprised of a main body including a unit of temporarily securing the user's body to the device while also covering their private parts such as anus or urethra, an inlet port for introducing a rinsing liquid for rinsing the private parts, and a drainage port for discharging the used rinse liquid long with discharge materials out of the main body. The main body also includes a sensor unit for sensing urination and/or defecation; a unit for discriminating defecation and urination from each other on the basis of outlet signals from the sensor unit and a unit for releasing a rinsing liquid for a predetermined time towards the private parts on the basis of discrimination by the discriminating unit.

10 Claims, 8 Drawing Sheets

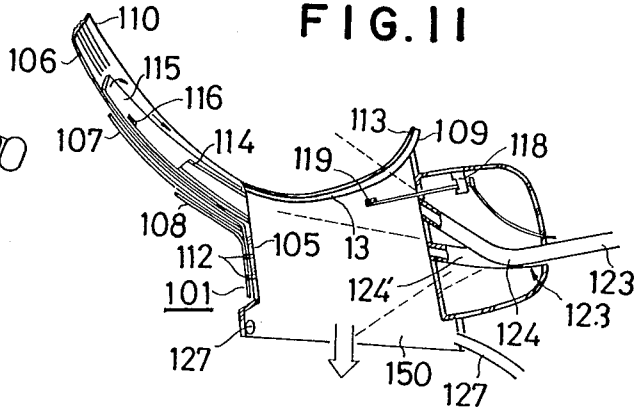
FIG. 11
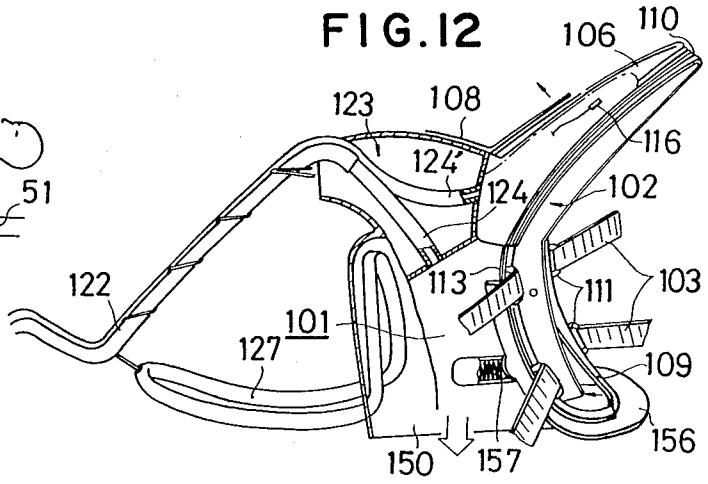
FIG. 12
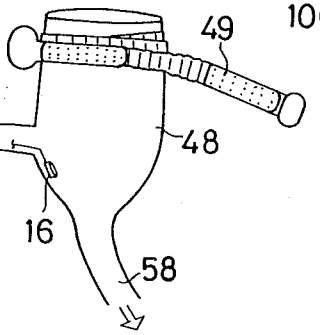
FIG. 8
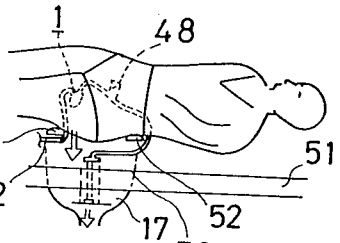
FIG. 9
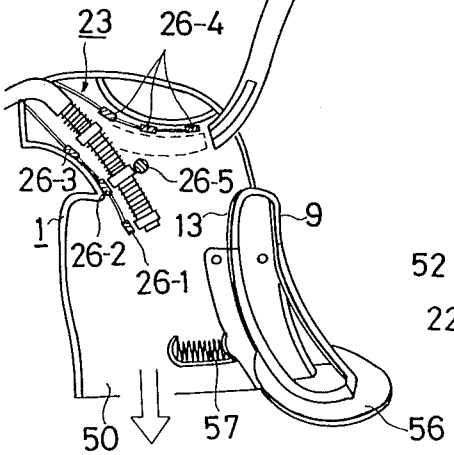

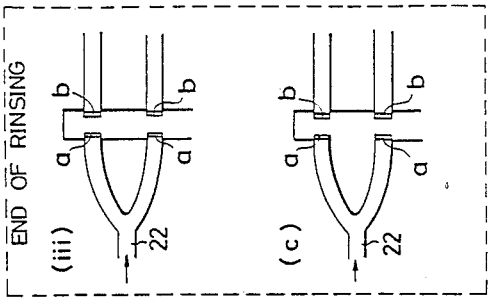
FIG. 18C
END OF RINSING
(iii)
(c)
22
a
b

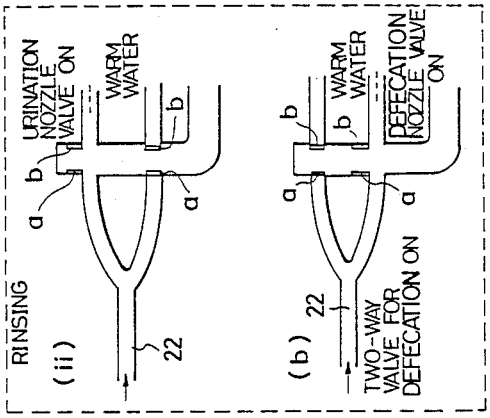
FIG. 18B
RINSING
(ii)
(b)
URINATION NOZZLE VALVE ON
WARM WATER
DEFECATION NOZZLE VALVE ON
TWO-WAY VALVE FOR DEFECATION ON
22
a
b

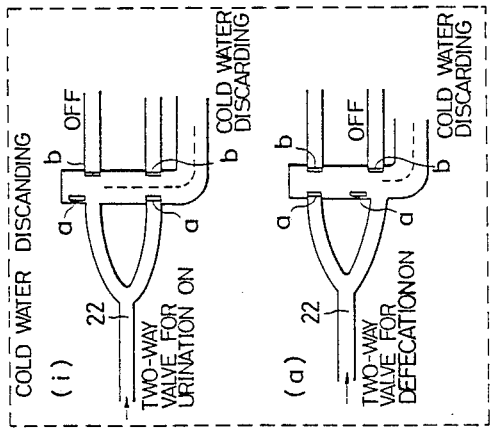
FIG. 18A
COLD WATER DISCANDING
(i)
(a)
OFF
COLD WATER DISCARDING
TWO-WAY VALVE FOR URINATION ON
TWO-WAY VALVE FOR DEFECATION ON
22
a
b

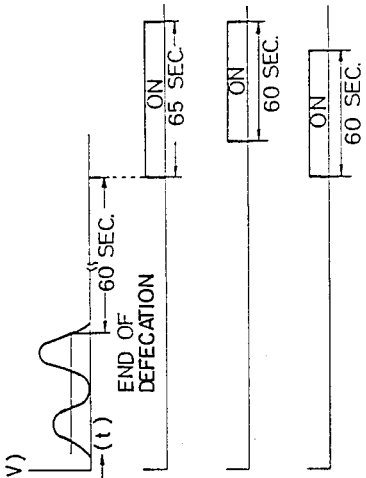
FIG. 23
(V)
PRESSURE SENSOR
(t)
60 SEC.
END OF DEFECATION
TIMER FOR MAGNETIC VALVE a FOR DEFECATION
TIMER FOR MAGNETIC VALVE b FOR DEFECATION
TIMER FOR MAGNETIC VALVE c FOR DEFECATION
ON
65 SEC.
60 SEC.

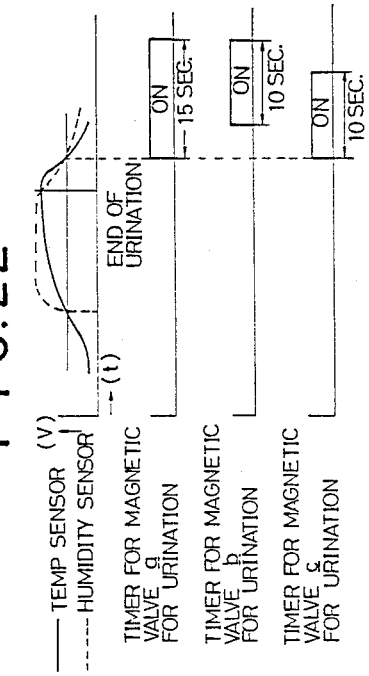
FIG. 22
(V)
TEMP SENSOR
HUMIDITY SENSOR
(t)
END OF URINATION
TIMER FOR MAGNETIC VALVE a FOR URINATION
TIMER FOR MAGNETIC VALVE b FOR URINATION
TIMER FOR MAGNETIC VALVE c FOR URINATION
ON
15 SEC.
10 SEC.

DEVICE FOR AUTOMATIC RINSING OF PRIVATE PARTS AFTER DEFECATION AND/OR URINATION OF PHYSICALLY DISABLED PERSONS

BACKGROUND OF THE INVENTION

1. Field of the Invention

This invention relates to a device for automatic rinsing of private parts after defecation and/or urination. More particularly, it relates to a device for rinsing of private parts at the time of defecation and/or urination of physically disabled persons, including the aged and patients.

2. Related Art Statement

In the currently used automatic rinsing devices, sensors are provided to the toilet bowl for sensing the defecation and/or urination and the rinsing liquid is discharged for a predetermined time with the aid of a timer for rinsing the private parts of the user such as anus. However, these known devices are adapted for healthy persons who can sit on the toilet during rinsing. These devices are not effective with physically disabled persons whose bodily movements are not at their will since they cannot get their private parts rinsed sufficiently. If they should try to wash their private parts at any rate, the rinsing liquid such as warm water will be scattered occasionally without being used effectively for rinsing. In our copending patent application (Japanese Laid-open Patent Publication No. 155252/1984) entitled "Device for Automatic Disposal of Bodily Waste Materials", the user's waste in its entirety is accommodated in a hermetically sealed container and both the shower and the warm air are introduced into the container. This device also is not completely satisfactory since it tends to be bulky and in need of a large amount of rinse water while unnecessarily restricting bodily movements of the users who can rise or sit on the bed at their will.

OBJECTS AND SUMMARY OF THE INVENTION

It is a principal object of the present invention to provide a device for automatic rinsing of private parts after defecation and/or urination of physically disabled persons while lying or sitting on the bed.

It is a further object of the present invention to provide a device for automatic rinsing of private parts after defecation and/or urination of physically disabled persons, which intimately contacts portions of the user's body to prevent scattering of the rinsing liquid.

It is a further object of the present invention to provide a device for automatic rinsing of private parts for physically disabled persons, which is easy to use and simple in structure.

The above and other objects of the invention will become apparent from the following description.

In view of these objects, the present invention provides a device for automatically rinsing private parts of the user's body after the urination and/or defecation which comprises a main body including means for temporarily securing the user's body to the device while covering their private parts including the opening for urination and the opening for defecation, an inlet port for introducing a rinsing liquid for rinsing the private parts, and a drainage port for discharging the used rinsing liquid along with discharge materials out of the main body; the main body including means for sensing urination and/or defecation, means for discriminating defecation and urination from each other on the basis of output signals from the sensor, and means for releasing the rinsing liquid for a predetermined time towards the private parts on the basis of the results of discrimination by the discriminating means.

BRIEF DESCRIPTION OF THE DRAWINGS

FIG. 8 is a perspective view showing the device of FIG. 5 which is adapted to be used by bedridden male users;

FIG. 9 is a view showing the operating state of the device shown in FIG. 8;

FIG. 11 is a side elevation, shown partially in section and showing a device for automatically rinsing private parts after defecation and/or urination of the female user according to a modified embodiment of the present invention;

FIG. 12 is a perspective view of a modified device adapted to be used by bedridden female users and operating under the same operating principle as the device of FIG. 11;

FIGS. 18A(i), 18B(ii) and 18C(iii) show the step of discarding cold water, the step of rinsing and the end of rinsing by the operation of the magnetic valve for urination of the device shown in FIG. 11, respectively, wherein FIGS. 18A(a), 18B(b) and 18C(c) show the step of discarding cold water, the step of rinsing and the end of rinsing by the operation of the magnetic valve for defecation, respectively, of the device shown in FIG. 11;

FIG. 22 is a timing chart showing the state of rinsing after urination by the device shown in FIG. 11;

FIG. 23 is a timing chart showing the state of rinsing after defecation by the device shown in FIG. 11.

PREFERRED EMBODIMENTS OF THE INVENTION

Figure 4:
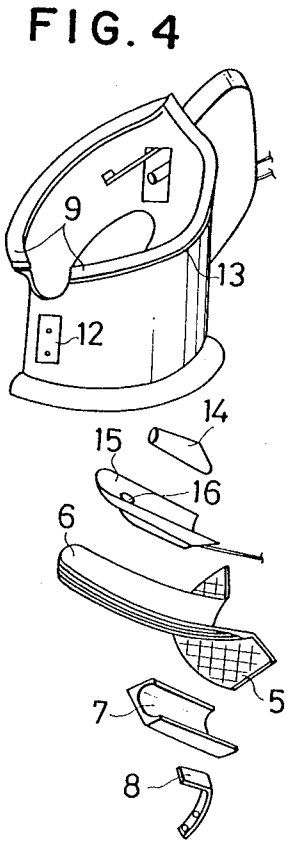
FIG. 4 is an exploded perspective view of FIG. 1.
Figure 3:
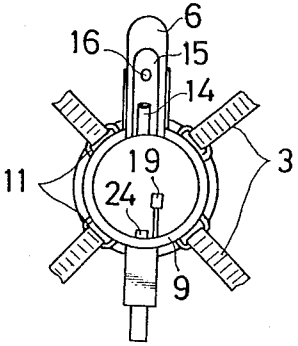
FIG. 3 is a top plan view of FIG. 1.

The automatic rinsing device according to preferred embodiments of the present invention will be hereafter explained by referring to the accompanying drawings.

Referring first to FIGS. 1 to 4, the main body 1 of the rinsing device has an upper opening watertightly contacting with private parts including a defecation opening (anus) and a urination opening (urethra) of the user's body. It has four upper attachment members 11 for engagement with four belts 3 acting as means for temporarily attaching the device to the user's body. A safety cover 6 for inhibiting water leakage is mounted integrally to the main body 1 at a juncture 12 along with a lower base 7 and a spring 8 in such a manner that the upper opening o the main body 1 will overlie not only the anus which is the opening for defecation but also the urethra which is the opening for urenation of the female user. The cover 6 is comprised of a base joint section 5 and an elongated trough 6 extending from the joint section. The spring 8 is adapted to press the water leakage safety cover 6 into intimate fitting with the private portions of the user's body. A shock-absorbing bellows-like member 10 is provided at the upper portion of the cover 6 which is the portion to contact with the user's body, in such a manner that the bellows-like member 10 is contiguous to a water-proofing member 9 provided on an upper frame 13 at the upper opening of the main body 1. The bellows-like member 10 is used as a packing to water-tightly seal the contacting portion with the user's body to prevent the rinsing liquid from leaking to outside of the rinsing device in cooperation with the water-proofing cushioning member 9. Inside the cover 6 is a reflux member or deflector 15 adapted to guide the rinsing liquid from the rinse liquid nozzle towards the urethral opening for rinsing the private portion including the urethral opening to then return the used rinsing liquid towards the toilet bowl. To this deflector 15 is attached a temperature and/or humidity sensor 16 to sense the urination. The output signals from the sensor are coupled to a defecation/urination discriminating unit which will be described. A guide piping 14 is adapted to guide the rinsing water from the nozzle towards the urethral opening and secured to the reflux member 15 by welding or with an adhesive.

Figure 7:
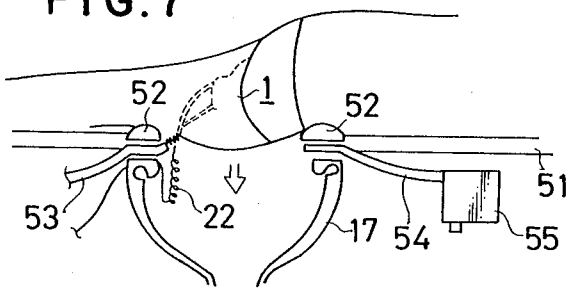
FIG. 7 is a view showing the operating state of the device shown in FIG. 6.

Below the main body 1 is a discharge opening 50 communicating with a toilet bowl 17, FIG. 7, for discharging the used rinsing water with the waste material. The opening 50 is connected with the toilet bowl lying in the direction of an arrow mark in FIG. 2 either directly or via a connecting hose, not shown. Preferably an electric heater 27 for warming the private parts is provided on the perimeter of the opening 50, the temperature of which is controlled to a preset constant value by a thermostat, not shown. In addition to the sensor 16, a pressure sensor 19 is also provided within the main body 1 of the rinsing device, the pressure sensor being disposed below the anus which is the opening for defecation, while also being vertically movable about a fulcrum 18. The signal from the sensor 19 is supplied to a defecation/urination discriminating unit as later descried.

Although the rinsing water may be supplied from the water main directly, the water supplied from the main may be stored in a water tank 20 and then supplied to a water heater 21 where it is heated to a suitable temperature and transmitted as rinsing warm water through a piping 22.

Figure 2:
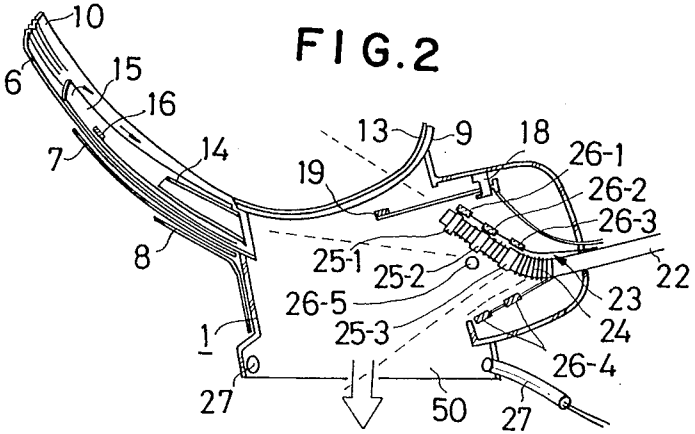
FIG. 2 is a central longitudinal section through the device shown in FIG. 1.
Figure 14:
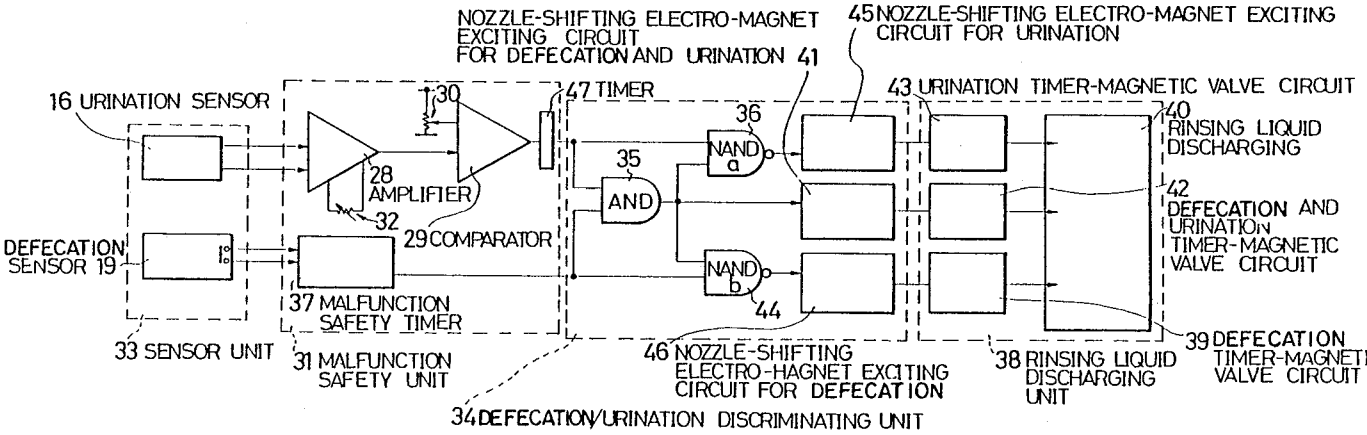
FIG. 14 is a block diagram showing a sensor unit, a defecation/urination discriminating unit and a rinsing liquid discharging unit of the device shown in FIG. 1.
Figure 16:
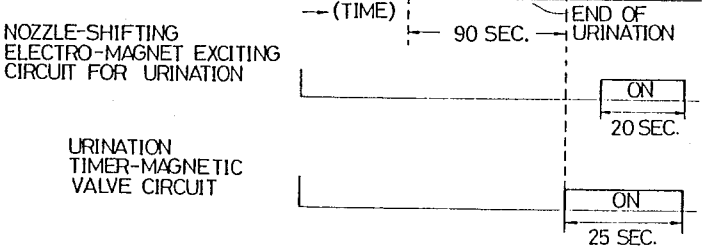
FIG. 16 shows a timing chart showing the state of rinsing after urination by the rinsing device shown in FIG. 1.
Figure 17:
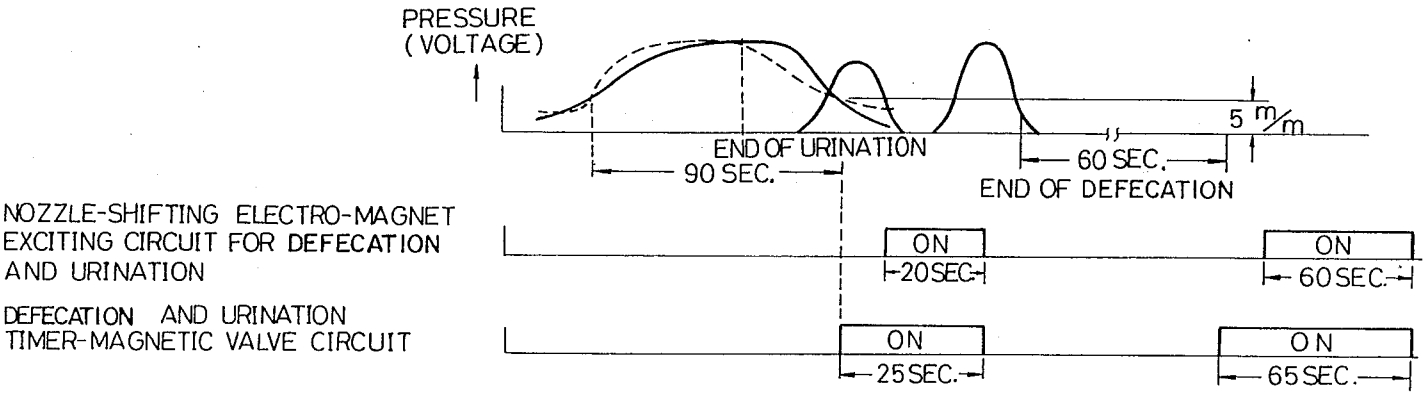
FIG. 17 shows a timing chart showing the state of rinsing after defecation and urination by the rinsing device shown in FIG. 1.

Referring to FIG. 2, a nozzle 24 is disposed in a water inlet port 23 and provided at predetermined distances with a plurality of iron segments 25-1, 25-2 and 25-3 operatively associated with timer-electro-magnets 26-1, 26-2, 26-3, 26-4 and 26-5. These electro-magnets are excited in dependence upon urination and/or defecation as sensed by the aforementioned sensors for shifting the nozzle 24 towards the opening for defecation and/or that for urination. Referring more specifically to FIGS. 14 and 17, in case of urination, an output signal indicating the state of urination from changes in temperature or humidity rises sharply through amplifier 28 of a malfunction safety unit 31. The amplified signal is compared in a comparator 29 with a voltage previously set on a potentiometer 30. When the output from the comparator 29 exceeds a preset value, timer 47 is started to produce a signal to command the discharge of rinsing water to take place after lapse of a certain time, as in 90 seconds after the end of urination, as shown in FIG. 16. The numeral 32 denotes a variable resistor for calibrating the operating temperature of the temperature sensor 18 of the sensor unit 33 as a function of seasonal changes in ambient atmospheric temperature. The signal from the comparator 29 of the unit 31 is passed through AND gate 35 and NAND a circuit 36 of a defecation/urination discriminating unit 34 in order to recognize urination. By the operation of a nozzle-shifting electro-magnet for urination-timer-magnet exciting circuit 45, a pair of electro-magnets 26-5 on both sides of the main body 1 are excited for shifting the nozzle 24 from its normal position facing to the electro-magnet 26-4 in the direction of the guide pipe 14 for holding the nozzle in this position for 20 seconds, see FIGS. 2 and 16. The signal indicating urination at the defecation/urination discriminating unit 34 causes an electro-magnet, not shown, of the water inlet port 23 to be opened with the aid of a urination timer-magnetic valve circuit 43 for emitting a rinsing liquid at 40 from the nozzle for 25 seconds in the direction of the guide pipe 14, FIGS. 2 and 16. The circuit 45 is fitted with the timer in order that the nozzle will be transferred in the direction of the guide pipe 14 after lapse of 5 seconds since the opening of the electro-magnet 45 for emitting the warm rinsing liquid from the water heater to the private parts of the body, FIG. 16. In this manner, the water which will flow in cold state from the water heater to the nozzle port in winter is not discharged directly to the private portions of the user's body.

Figure 15:
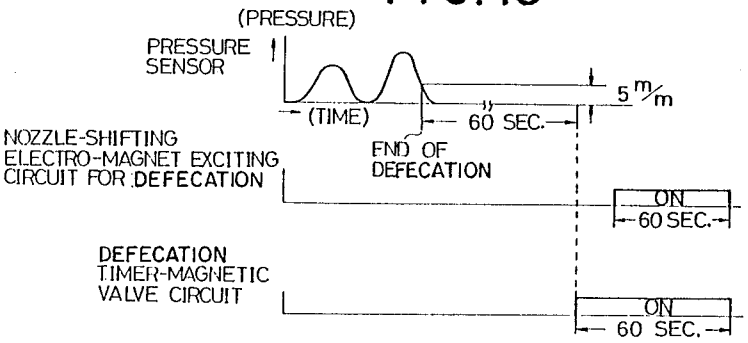
FIG. 15 shows a timing chart showing the state of rinsing after defecation by the rinsing device shown in FIG. 1.

Then, as shown in FIGS. 14 and 15, the signal that has sensed the state of urination at the pressure sensor 19 of the sensor unit 33 ceases for 60 seconds in order to wait for complete cessation of defecation with the aid of the timer 37 of the malfunction safety unit 31. The signal is then passed through AND gate 35 and NAND b gate 44 of the unit 34 to recognize the defecation to then excite the electro-magnets 26-1, 26-2 and 26-3 with the aid of a nozzle-shifting electro-magnet-timer-magnet exciting circuit 46 for shifting the nozzle 24 in the direction of the anus which is the opening for defecation so that the nozzle 24 will remain in this position for about 60 seconds, see FIG. 2. The signal indicative of the state of defecation in the defecation/urination discriminating unit 34 causes the magnetic valve, not shown, of the water inlet port 23 to be opened with the aid of a defecation timer-magnetic valve circuit 39 of a rinsing liquid discharging unit 38 for discharging the rinsing liquid at 40 for 65 seconds from the nozzle to the anus which is the opening of defecation. The nozzle-shifting electro-magnet for defecation-timer-magnet exciting circuit can be designed, as shown in FIG. 15, to shift the nozzle in 5 seconds after the opening of the magnetic valve to prevent the cold water from being discharged to the private portions.

Then, referring to FIGS. 14 and 17, the signals indicative of both the defecation and urination at the pressure sensor 19 and the temperature or humidity sensor 16 of the sensor unit 33 are passed through the malfunction safety unit 31 to recognize both the defecation and urination at the AND gate 35 of the discrimination unit 34. The resulting signal is transmitted via nozzle-shifting electro-magnet-timer-magnet exciting circuit 41 for sequentially exciting electro-magnets 26-5, 26-1, 26-2 and 26-3 with the aid of the timer in such a manner that, in 90 seconds after the urination signal has first reached a predetermined voltage value, the nozzle is directed towards the opening for urination and a rinsing liquid is discharged for 25 seconds for rinsing the opening for urination for 20 seconds, and that, in 60 seconds after the end of defecation, the nozzle is directed towards the anus and the magnetic valve, not shown, is opened by the defecation/urination timer-magnetic valve circuit 42 of the rinsing liquid discharging unit 38 to discharge the rinsing liquid for 65 seconds. It will be noted that the rinsing liquid is to be discharged for 5 seconds before nozzle shifting so as not to cause cold water to be discharged to the private portions of the user's body.

Figure 5:
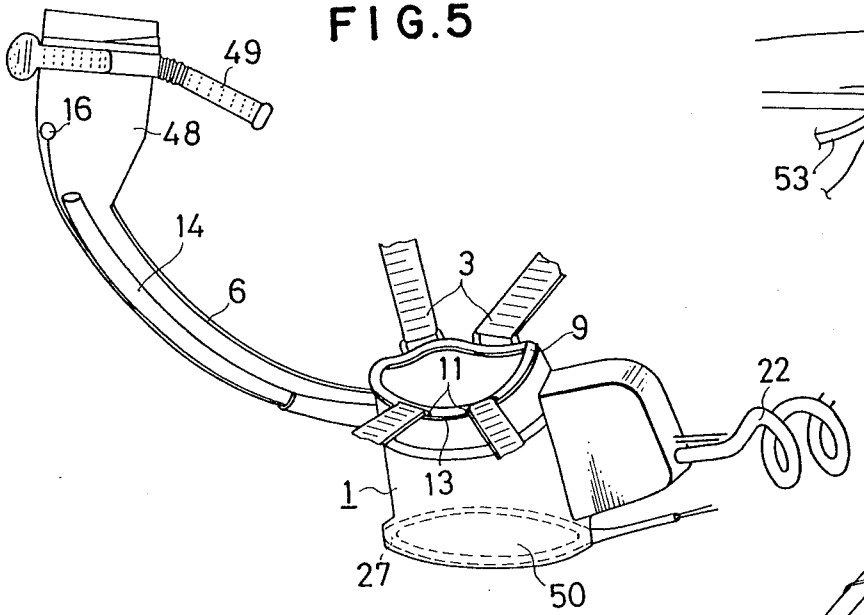
FIG. 5 is a perspective view of a modified device used solely by male users and operating on the same principle as the embodiment of FIG. 1.

FIG. 5 shows the inventive automatic rinsing device adapted for male users. The device shown in FIG. 5 differs from the embodiment shown in FIGS. 1 through 4 in that the leakage safety cover 6 is a long tube in which a temperature or humidity sensor 16 for sensing the urination and a guide pipe 14 are led closely to a washing pouch 48 into which the opening of male user's urethral opening is introduced and that a fastener 49 including a hook, loop and a string for attachment to a penis is mounted to the washing pouch 48. In other respects, the present embodiment is similar to the device for the female user described in connection with FIGS. 1 through 4.

Figure 1:
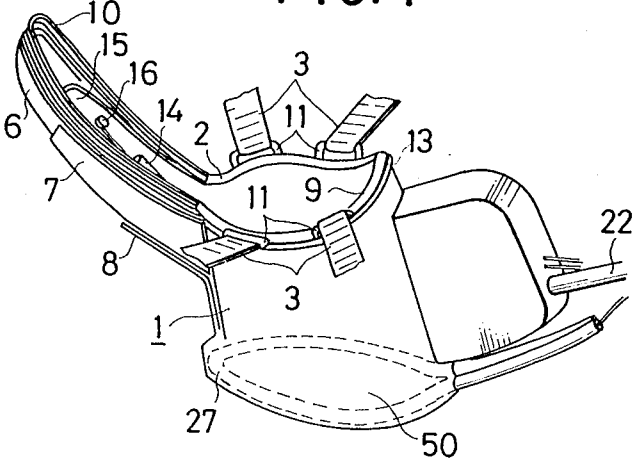
FIG. 1 is a perspective view showing a device according to a first embodiment of the present invention, the device being used solely by female users for rinsing their private parts after defecation and/or urination.
Figure 6:
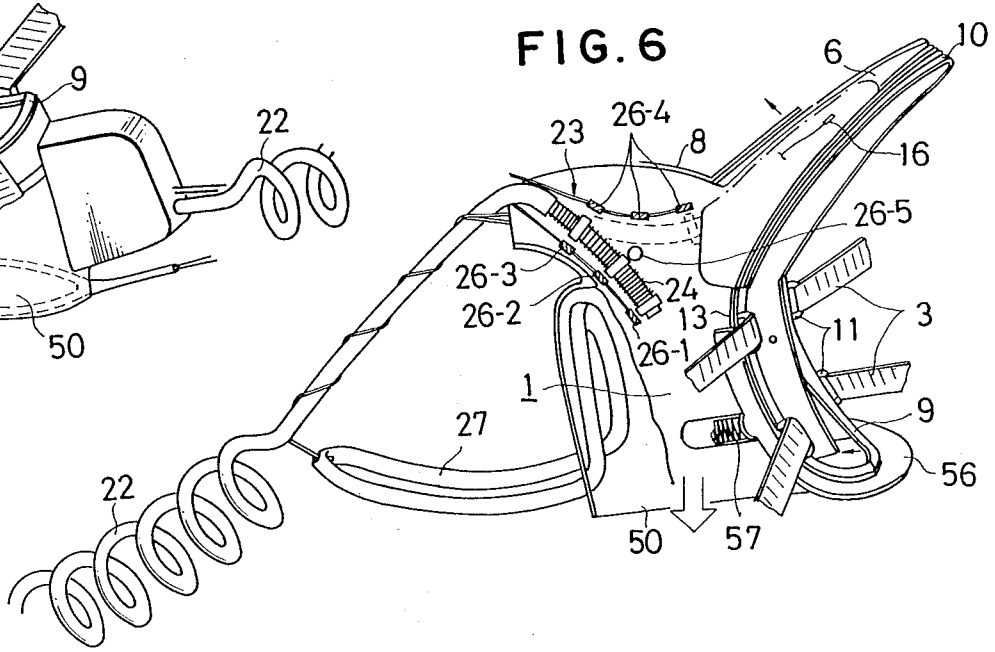
FIG. 6 is a perspective view of a further modified device used solely by bedridden female users and operating on the same principle as tee embodiment of FIG. 1.

FIG. 6 shows an automatic rinsing device which is used by female users as the embodiment shown in FIG. 1. The present embodiment differs from the device shown in FIG. 1 in that it is adapted to be used by bedridden patients. The rinsing device of the present device has a water inlet port 24 from the water supply system at the front lower side of the main body 1 and a water discharge port 50 communicating with toilet bowl 17 (FIG. 7) at the rear side of the main body 1. In addition, the timer-nozzle-shifting electro-magnets 26-1, 26-2, 26-3, 26-4 and 26-5 of the defecation/urination discriminating unit 34 and the nozzle 24 are provided to the water inlet port 23. The nozzle-shifting electro-magnet for urination-timer-magnet exciting circuit 45 is operatively associated with the timer-nozzle-shifting electro-magnet for urination 26-4. Similarly, the nozzle-shifting electro-magnet for defecation-timer-magnet exciting circuit 46 is operatively associated with the timer-nozzle-shifting electro-magnet for defecation 26-5, and the nozzle-shifting electro-magnet for defecation/urination-timer-magnet exciting circuit 41 is operatively associated with the timer-nozzle-shifting electro-magnets for defecation/urination 26-4 and 26-5, with the timer-nozzle-shifting electro-magnets 26-1, 26-2, and 26-3 indicating the normal position for the nozzle 24. In FIG. 6, the numeral 56 denotes a water deflector below the user's buttock and the numeral 57 a spring adapted to fit the water-cushioning member 9 with the buttock. FIG. 7 shows the state in which the present rinsing device is mounted in position to permit the user to urinate on a seat 52 of the toilet bowl mounted on the bed. In the drawing, the numeral 53 denotes a front side warm air discharge port from an air heater, not shown, and the numeral 54 a rear side warm air discharge port from an air heater 55 adapted for drying the private parts after rinsing.

FIG. 8 shows an automatic rinsing device for males similar to the embodiment shown in FIG. 5. The device of FIG. 8 differs from the device shown in FIG. 5 in that it is used by bedridden users. The device shown in FIG. 8 has a water inlet port 23 from the water supply device at the front lower side of the main body 1 and a water discharge port 50 communicating with the toilet bowl 17 at the rear side of the main body 1. The device shown in FIG. 8 also has a nozzle 24, timer-nozzle-shifting electro-magnets 26-1, 26-2, 26-3, 26-4 and 26-5, and a drain tube 58 in the pouch 48 for draining the used rinse water and urine into the toilet bowl 17. The parts used in the device of FIG. 8 are configured similarly to the corresponding parts used in FIG. 6. FIG. 9 shows the state in which the device shown in FIG. 8 is mounted in position to permit the user to defecate on the seat of the toilet bowl 17 mounted on the bed.

Figures 10, 13:
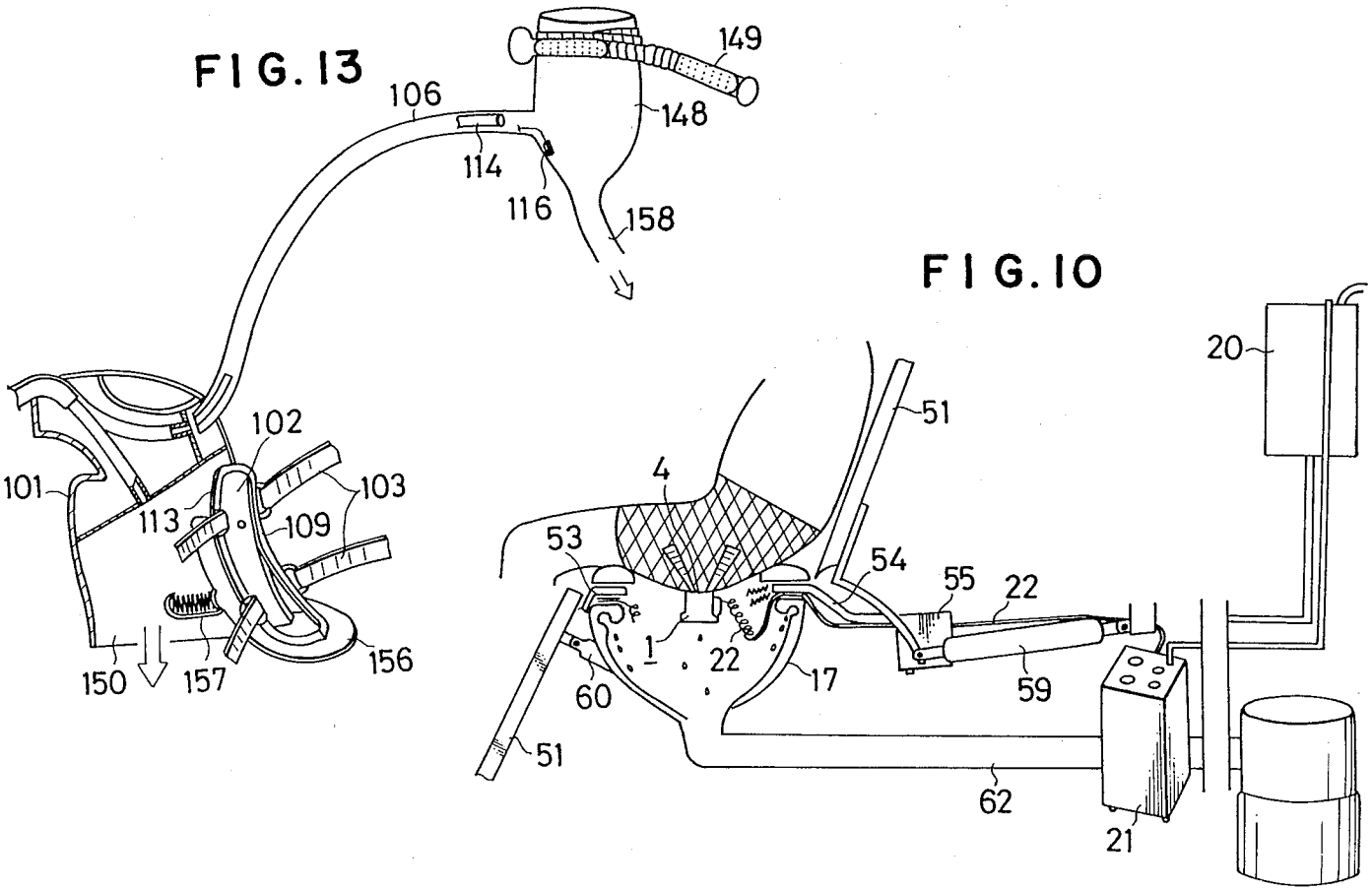
FIG. 10 is a side elevation showing the device of FIG. 1 or FIG. 5 in conjunction with a reclining type bed.
FIG. 13 is a perspective view of another modified device adapted to be used by bedridden male users and operating under the same operating principle as the device of FIG. 11.

FIG. 10 shows the state in which the device shown in FIG. 1 or 5 is used in conjunction with a reclining type bed 51 to permit the user to defecate with a part of the bed used as a backrest. In this figure, the numeral 61 designates a tank in which is stored the waste material delivered from the toilet bowl 17 through a waste material drainage pipe 62 and a vacuum unit, not shown. The reclining can be achieved by extending or contracting a pair of cylinders 59 and 60 by the operation of a driving circuit, not shown, on the basis of the output signals from the sensor 33 at the time of urination and/or defecation, FIGS. 1 and 5.

The automatic rinsing device according to a modified embodiment of the present invention will be explained by referring to FIGS. 11 through 13. The device shown in FIG. 11 corresponds to the device show in FIGS. 1 to 5. The device shown in FIG. 12 corresponds to the device shown in FIG. 6, while the device shown in FIG. 13 corresponds to the device shown in FIG. 8. The devices shown in FIGS. 11, 12 and 13 are similar to the devices shown in FIGS. 1–5, 6 and 8 of the first embodiment except that stationary nozzles 124, 124' are used in place of the movable nozzle 24 provided with the iron segments 25-1, 25-2 and 25-3 and the timer-electro-magnets 26-1, 26-2, 26-3, 26-4 and 26-5. For this reason, the parts shown in FIGS. 11 through 13 and similar to those used in the above described first embodiment are denoted by the same numerals but added by 100 and the corresponding description is omitted. Similarly, when reference is made to FIGS. 18 through 24 for explaining the second embodiment, the same or similar parts as those used in the first embodiment are denoted by the same reference numerals added by 100 and the corresponding description is not made for simplicity.

Figure 21:
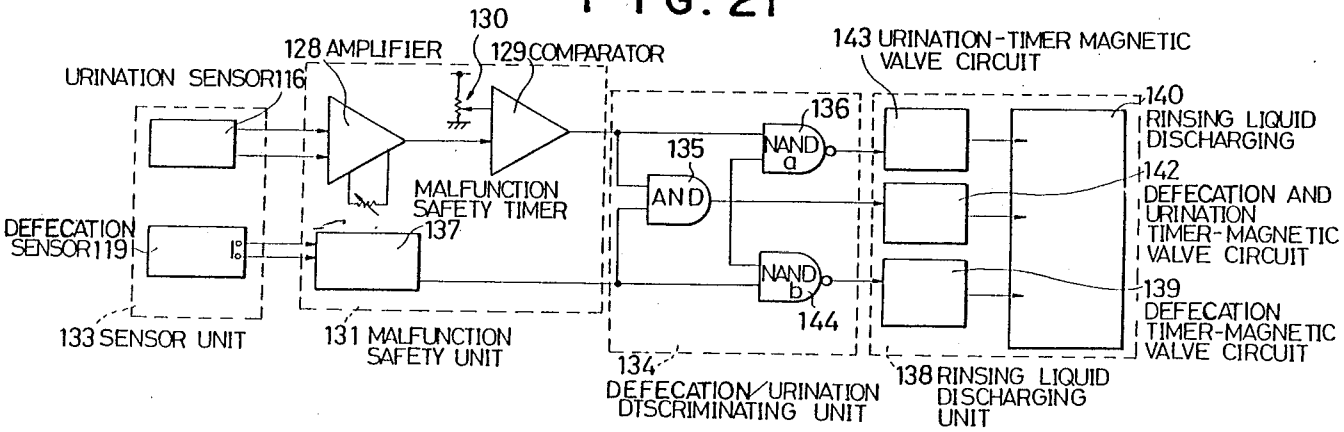
FIG. 21 is a block diagram showing the sensor unit, defecation/urination discriminating unit and the rinsing liquid discharging unit of the rinsing device of FIG. 11.

Referring now to FIGS. 18 and 21, the signal from a comparator 129 of a malfunction safety unit 131 is transmitted through an AND gate 135 and a NAND a gate 136 of the defecation/urination discriminating unit 134 to recognize only urination. By signals from the unit 134 indicating urination, the magnetic valves a and b for urination between the water supply device and the water supply port are opened with the aid of the urination timer-magnetic valve circuit 143 of the rinsing liquid discharging unit 138 to discharge rinsing liquid at 140 for 10 seconds from the nozzle towards the guide pipe 114. Referring more particularly to FIGS. 18A(i), 18B(ii), 18C(iii) and 22, the 15-second timer of the magnetic valve a for urination is actuated to turn on the magnetic valve for urination to discard the cold rinsing water from the water heater 121 (FIG. 19) to the valve into the toilet bowl 17, see (i). The magnetic valve b for urination is turned on for 10 seconds by the 10-second timer of the magnetic valve b for urination for emitting the rinsing liquid to the private parts, see (ii), the valves and b being then turned off, see (iii). In this manner, there may be avoided a situation in which the cold water between the valve and the water heater is emitted directly to the private parts during the aforementioned 5 seconds in winter.

Figure 20A:
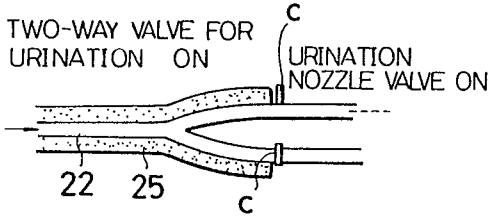
FIGS. 20A and 20B show further modified forms of FIG. 19.

In FIGS. 11, 18A, B and C, the water passage between the water heater 121 and the valve is divided into a defecation nozzle 124 and a urination nozzle 124' with the use of a bifurcated pipe. Alternatively, the piping for defecation and that for urination may be directly divided from the water heater 121. FIG. 20 shows a further embodiment in which a heat reserving device 125 such as a heater is provided in the water passage between the water heater 121 and the valve. In this case, the timer for the magnetic valve c for urination may be turned on for 10 seconds by the operation of the circuit 145 to turn on the magnetic valve e for urination, FIG. 20A, so that the warm water will be discharged at 140 to the private parts of the user's body.

Figure 20B:
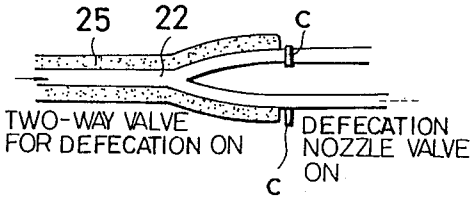
Figure 19:
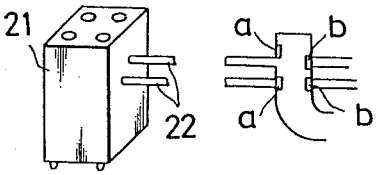
FIG. 19 shows a modification in which the piping for rinsing the anus and that for rinsing the urethra are branched at the water heater.

The signal from the pressure sensor 119 of the sensor unit 133 indicating defecation, FIG. 21, is transmitted to the malfunction safety circuit 137 of the malfunction safety unit 331 where the signal ceases for 60 seconds in order to wait for complete cessation of defecation. The output signal from the unit 131 is then transmitted through the AND gate 135 and NAND b gate 144 of the defecation/urination discriminating unit 134 in order to ascertain excretion of faces. On the other hand, the signal from the unit 134 indicating defecation causes the magnetic valves and b between the water supply unit and the water inlet port 123 to be opened with the aid of the defecation timer-magnetic valve circuit 139 of the rinse liquid discharging unit 138 to discharge the rinsing liquid at 140 for 60 seconds from the nozzle towards the anus which is the opening for defecation. Referring to FIGS. 18A(a), 18B(b), 18C(c) and 23, it is also possible in this case to turn on the magnetic valve for defecation only for discarding the cold rinsing liquid between the water heater 121 and the valve for 5 seconds into the toilet bowl 17, FIG. 18A(a), the magnet valve for defecation b then being turned off for 60 seconds with the aid of the 60-second timer of the magnetic valve b to discharge the rinsing liquid to the private parts, FIG. 18B(b), the valves a and b then being turned off, FIG. 18C(c). In this manner, there is no risk of directly discharging cold water towards the private parts. When the heat reserving means 125 such as an electric heater is provided between the water heater 121 and the valve, as shown in FIGS. 20(A) and 20(B), the magnetic valve c for defecation may be activated for 60 seconds by the operation of the defecation timer-magnetic valve circuit 139 to turn on the valve c, FIG. 20(B), to discharge warm water to the private parts at 140.

Figure 24:
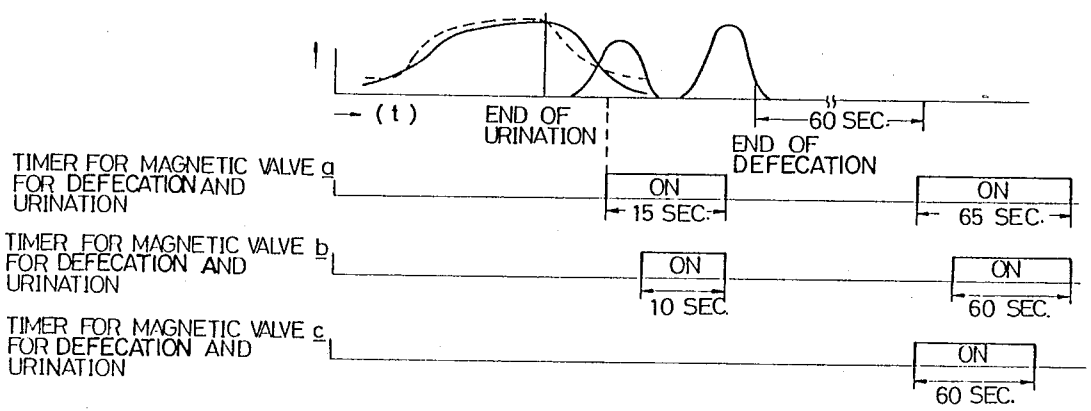
FIG. 24 is a timing chart showing the state of rinsing after defecation and urination by the device shown in FIG. 11.

The signals from the pressure sensor 119 and the temperature or humidity sensor 116 of the sensor unit 133 indicating both defecation and urination, FIG. 24, are transmitted via malfunction safety unit 131 to ascertain excretion of both feces and urine by the AND gate 135 of the discriminating unit 134. The output signal from the unit 134 indicating both defecation and urination is transmitted to the defecation/urination timer-magnetic valve 142 of the rinse liquid discharging unit 138. The defecation/urination timer-magnetic valve circuit 142 operates as follows: The signal from the urination sensor causes the magnetic valves a and b for urination between the water supply device and the water inlet port 123 to be turned on to permit the rinse liquid to be discharged for 10 seconds from the nozzle towards the guide pipe 114. The signal from the defecation sensor 119 causes magnetic valves for defecation and b to be turned on to permit the rinsing liquid to be discharged at 140 from the nozzle towards the anus for 60 seconds after lapse of 60 seconds since the end of defecation. It will be noted that the magnetic valve b for urination or defecation is turned on 5 seconds before the valve to drain cold water into the toilet bowl 17 instead of discharging it towards the private parts. Alternatively, when the heater or the like heat reserving means 25 is provided as described hereinabove, the timer-magnetic valve circuit 142 may be so designed that the timer of each magnetic valve for defecation or urination is started in 60 seconds after the end of defecation to turn on the magnetic valves for urination and defecation, connecting to the nozzle 124 for defecation and to the nozzle 124' for urination, so as to discharge warm water at 140 towards the private parts.

Although the present invention has been described with reference to the preferred embodiments, it should be understood that various modifications and variations can be easily made by those skilled in the art without departing from the spirit of the invention. Accordingly, the foregoing disclosure should be interpreted as illustrative only and not to be interpreted in a limiting sense. The present invention is limited only by the scope of the following claims.

What is claimed is:

1. A device for automatically rinsing private parts of a user's body after the urination and/or defecation comprising a main body including in turn means for temporarily securing the user's body to the device while covering private parts inclusive of an opening for urination and an opening for defecation, an inlet port for introducing a rinsing liquid for rinsing the private parts, and a drainage port for discharging the used rinsing liquid with discharge materials out of the main body; said main body including means for sensing urination and/or defecation; means for discriminating defecation and urination from each other on the basis of output signals from said sensing means, and means for releasing the rinsing liquid for a predetermined time towards the private parts inclusive of the openings for urination and/or defecation on the basis of the results of discrimination by said discriminating means, wherein said rinsing liquid releasing means includes a resilient nozzle provided to said inlet port and means for deviating said resilient nozzle towards the opening for defecation and towards the opening for urination, and said means for deviating the resilient nozzle comprises iron segments secured to said nozzle and electro-magnets secured to the main body for selectively attracting the iron segments thereto.

2. A device for automatically rinsing private parts of a user's body after the urination and/or defecation comprising a main body including in turn means for temporarily securing the user's body to the device while covering private parts inclusive of an opening for urination and an opening for defecation, an inlet port for introducing a rinsing liquid for rinsing the private parts, and a drainage port for discharging the used rinsing liquid with discharge materials out of the main body; said main body including means for sensing urination and/or defecation; means for discriminating defecation and urination from each other on the basis of output signals from said sensing means, and means for releasing the rinsing liquid for a predetermined time towards the private parts inclusive of the openings for urination and/or defecation on the basis of the results of discrimination by said discriminating means, wherein the output signal as sensed by said sensing means and indicating urination and/or defecation is amplified and compared to a preset value and the resulting signal in excess of a preset voltage actuates a timer which transmits the rinsing liquid demand signal after lapse of a preset time since the end of urination and/or defecation, and further wherein said rinsing liquid demand signal is supplied to a defecation/urination discriminating unit, and a first nozzle-shifting electro-magnet-timer-magnet exciting circuit of said discriminating unit causes a resilient nozzle to be directed towards a urethra of the user for a predetermined time.

3. A device according to claim 2 wherein a second nozzle-shifting electro-magnet-timer-magnet exciting circuit of said discriminating unit causes a resilient nozzle to be directed towards the anus of the user for a predetermined time.

4. A device according to claim 3 wherein the output signals from said first and second exciting circuits of the discriminating unit are supplied to a rinsing liquid discharging unit.

5. A device according to claim 4 wherein a first timer and magnetic valve circuit of the rinsing liquid discharging unit causes the rinsing liquid to be discharged for a first predetermined time.

6. A device according to claim 3 wherein a second timer and magnetic valve circuit of the rinsing liquid discharging unit causes th rinsing liquid to be discharged for a second predetermined time.

7. A device according to claim 2 wherein said first nozzle-shifting electro-magnet-timer-magnet exciting circuit of the discriminating unit is so designed as to cause the nozzle to be directed to the user's urethra after a shorter time since the time of opening of the magnetic valve.

8. A device according to claim 3 wherein said second nozzle-shifting electro-magnet-timer-magnet exciting circuit causes the nozzle to be directed towards the anus of the user after a shorter time since the opening of the valve.

9. A device for automatically rinsing private parts of a user's body after the urination and/or defecation comprising a main body including in turn means for temporarily securing the user's body to the device while covering private parts inclusive of an opening for urination and an opening for defecation, an inlet port for introducing a rinsing liquid for rinsing the private parts, and a drainage port for discharging the used rinsing liquid with discharge materials out of the main body; said main body including means for sensing urination and/or defecation; means for discriminating defecation and urination from each other on the basis of output signals from said sensing means, and means for releasing the rinsing liquid for a predetermined time towards the private parts inclusive of the openings for urination and/or defecation on the basis of the results of discrimination by said discriminating means, wherein signals as sensed by said sensing means and indicating both defecation and urination are supplied to a nozzle-shifting electro-magnet-timer-magnet for defecation/urination-timer-magnet exciting circuit operating to sequentially excite the electro-magnets in such a manner that the urethra of the user's body is first rinsed for a first predetermined time by the rinsing liquid and the anus of the user's body is then rinsed for a second predetermined time by the rinsing liquid.

10. A device as claimed in claim 9 wherein the discharging of the rinsing liquid towards the urethra or anus is started a short time before nozzle shifting.

* * * * *